United States Patent [19]

Stralow

[11] Patent Number: 4,944,649

[45] Date of Patent: Jul. 31, 1990

[54] MECHANISM FOR COUPLING SUBORDINATE MACHINE TO TRACTOR

[76] Inventor: Cecil J. Stralow, 14672 Brookstone Dr., Poway, Calif. 92064

[21] Appl. No.: 339,934

[22] Filed: Apr. 19, 1989

Related U.S. Application Data

[63] Continuation-in-part of Ser. No. 143,016, Jan. 12, 1988, abandoned, which is a continuation-in-part of Ser. No. 887,811, Jul. 21, 1986, Pat. No. 4,720,234.

[51] Int. Cl.[5] ..... E02F 3/32

[52] U.S. Cl. ..... 414/686; 172/47; 172/443; 172/447; 280/492; 414/694; 414/703

[58] Field of Search ..... 414/686, 690, 694, 703, 414/687, 607, 920; 280/492, 494; 172/47, 447, 474, 443, 444, 477, 272–275

[56] References Cited

U.S. PATENT DOCUMENTS

| | | | |
|---|---|---|---|
| 1,501,652 | 7/1924 | Ferguson | 172/447 X |
| 2,394,210 | 2/1946 | Sherman | 172/446 |
| 2,622,749 | 12/1952 | Stuhr | 414/703 X |
| 3,049,822 | 8/1962 | McMullen | 172/668 |
| 3,170,300 | 2/1965 | Kelly | 406/120 |
| 3,276,984 | 4/1966 | Long et al. | 414/694 |
| 3,282,452 | 11/1966 | Parsen | 414/694 |
| 3,465,904 | 9/1969 | Pensa | 414/694 |
| 3,571,956 | 3/1971 | Heiberg | 172/477 |
| 3,613,800 | 10/1971 | Martin | 172/445.2 |
| 3,820,609 | 6/1974 | Trott | 172/445.2 |
| 3,858,663 | 1/1975 | Lurwig | 172/445.2 |
| 3,966,065 | 6/1976 | Jones | 280/461 |
| 3,973,632 | 8/1976 | Torazzi | 172/474 X |
| 3,987,914 | 10/1976 | VanDerZyl et al. | 414/694 |
| 4,061,194 | 12/1977 | McCause | 172/445.2 |
| 4,074,821 | 2/1978 | Long | 414/694 |
| 4,102,403 | 7/1978 | Steinberg | 172/477 X |
| 4,278,394 | 7/1981 | Johnson | 414/694 |
| 4,358,240 | 11/1982 | Shumaker | 414/694 |
| 4,720,234 | 1/1988 | Stralow | 414/686 |

FOREIGN PATENT DOCUMENTS

| | | | |
|---|---|---|---|
| 1913581 | 9/1970 | Fed. Rep. of Germany . | |
| 2653299 | 6/1977 | Fed. Rep. of Germany | 172/443 |

OTHER PUBLICATIONS

Stralow Circular C and Copyright and Sketches A and B, showing prior art removal of entire main frame structure from tractor.

*Primary Examiner*—Robert J. Spar
*Assistant Examiner*—Donald W. Underwood
*Attorney, Agent, or Firm*—Charles M. Hogan

[57] ABSTRACT

This is a swing-tower arrangement for coupling a backhoe assembly to a tractor or the like. It features a rocker swingable in elevation on the swing tower. An actuator on the swing tower controls the position of the rocker, improving transport and control of the backhoe and making practical the adaptation of the arrangement to a wide range of tows. Detachable rockers are variously used to shift the backhoe assembly to transport and working positions and to tow and lift other types of subordinate machines. A power takeoff is mounted on the rocker.

9 Claims, 11 Drawing Sheets

MECHANISM FOR COUPLING SUBORDINATE MACHINE TO TRACTOR

This application is a continuation-in-part of my application Ser. No. 143,016, filed Jan. 12, 1988. Said prior patent application Ser. No. 143,016, now abandoned, was in turn a continuation-in-part of my U.S. patent application Ser. No. 887,811, filed in the U.S. Patent and Trademark Office on July 21, 1986, and entitled "Improved Backhoe", now U.S. Pat. No. 4,720,234 issued Jan. 19, 1988.

BACKGROUND OF THE INVENTION

This invention was conceived as a solution to the problem of providing a swing tower mechanism and backhoe assembly which possesses two advantages not found together in prior art machines. One advantage is improved balance, i.e., retraction closer to the tractor rear when the backhoe is being transported. The other is ready detachability of the backhoe.

As shown in my copending U.S. Pat. No. 4,720,234, various backhoe arrangements have been devised in efforts to improve operator visibility and bring the center of gravity of the backhoe closer to the tractor when the backhoe is being transported. These are:

First, that of U.S. Pat. No. 3,376,984 to Long and Shumaker, featuring a boom and two outboard boom cylinders, all pivotally mounted on a swing tower so that the boom cylinders flank the boom in a clearance relationship;

Second, that of U.S. Pat. No. 3,987,914 to VanDerZyl, McMullen and Kraske, in which the boom is constructed in two sections, with the boom cylinder having its cylinder side pivotally secured directly to the swing tower;

Third, that of U.S. Pat. No. 4,074,821 to Long, featuring a boom cylinder and two outboard boom sections which flank the cylinder; and Fourth, that of U.S. Pat. No. 4,358,240 to Shumaker, in which the boom and boom cylinder are pivotally mounted in offset relation on a swing tower.

Each prior art structure suffers from one or more of the following limitations: Obstruction of the operator's view, lack of practical detachability, or insufficient achievement of good balance during transport of the backhoe. In providing a solution which is relatively free of the disadvantages and limitations of the prior art, I conceived of a swing tower mechanism in which the backhoe assembly proper is mounted on a rocker, which shifts the backhoe assembly between transport and working positions, making a substantial improvement in the balance of the tractor-backhoe ensemble. In the improved backhoe of my U.S. Pat. No. 4,720,234, I positioned the bucket on the ground and used thrust of the boom cylinder against the rocker to put the rocker in transport mode and enable the backhoe to go into transport position. I later conceived the idea that the rocker positioning could be controlled from the swing tower by mounting a rocker-control hydraulic cylinder on the swing tower. Then positioning of the rocker could be controlled without depending on the subordinate machine. This led to the perception that the combination of swing tower, rocker and rocker-actuating cylinder constituted the basis for a three-point hitch, so that now a tractor suitable for a backhoe could be used to support, transport, elevate and depress, lift, tow, move in azimuth or allow to move in azimuth, a wide range of subordinate machines; for example, the blade 52 of FIGS. 13 and 14. Optionally, a hydraulic motor with power-takeoff shaft can also be mounted on the rocker (FIGS. 11, 16, 17). Such a power takeoff, being carried by the rocker, automatically moves in elevation and azimuth with the subordinate vehicle or machine. Thus, the combination of swing tower, rocker, and hydraulic actuator, with the capacity to transport and position the rocker load, has very wide application.

SUMMARY OF THE INVENTION

The major respects in which the instant disclosure departs from that of the originally filed patent application are: The addition of the actuator mounted on the swing tower and the provision of various types of rockers, both changes greatly expanding the field of utility of the invention. Further, a power takeoff is mounted on the rocker.

The preferred embodiment of the invention is first shown as coupling a backhoe assembly to a tractor. In that environment the invention is in the category of structures intended to bring the dipper assembly in closer to the tractor during transport. The invention has further utility in towing and elevational positioning of various subordinate loads or machines. It is of particular advantage when providing a three-point hitch.

OBJECTS

The primary object of the invention is to provide swing tower, rocker and 3-point hitch combinations for coupling a subordinate machine to a tractor in such a way as to accomplish controlled and positive positioning of the subordinate machine in azimuth and throughout a range of elevation including transport and working positions.

Another object of the invention is to provide a swing tower arrangement featuring a rocker and actuating means mounted on the swing tower for positioning the rocker in elevation, the rocker being formed to govern the positioning and transport of the subordinate mechanism.

It is also an object of the invention to provide a power takeoff mechanism carried by the rocker and therefore movable in elevation and azimuth with the subordinate machine.

An object of the invention is further to provide a swing tower mounting frame and three-point hitch arrangement capable of controlling the transport and positioning in elevation and azimuth of a drawn and/or supported load.

Yet another object of the invention is to improve the swing tower arrangement disclosed in my aforesaid U.S. Pat. No. 4,720,234, in such a way as to provide elevational control by means on the swing tower, thereby to extend the range and types of load that can be towed by the tractor vehicle.

A general object of the invention is to realize the full capabilities of the combination of hitch frame or rocker, swing tower and azimuth and elevational actuators as a hitching structure with a wide range of subordinate machines or loads.

DRAWINGS

For a better understanding of the invention, together with other objects, advantages and capabilites thereof, reference is made to the following description of the accompanying drawings, in which.

Figure 1:
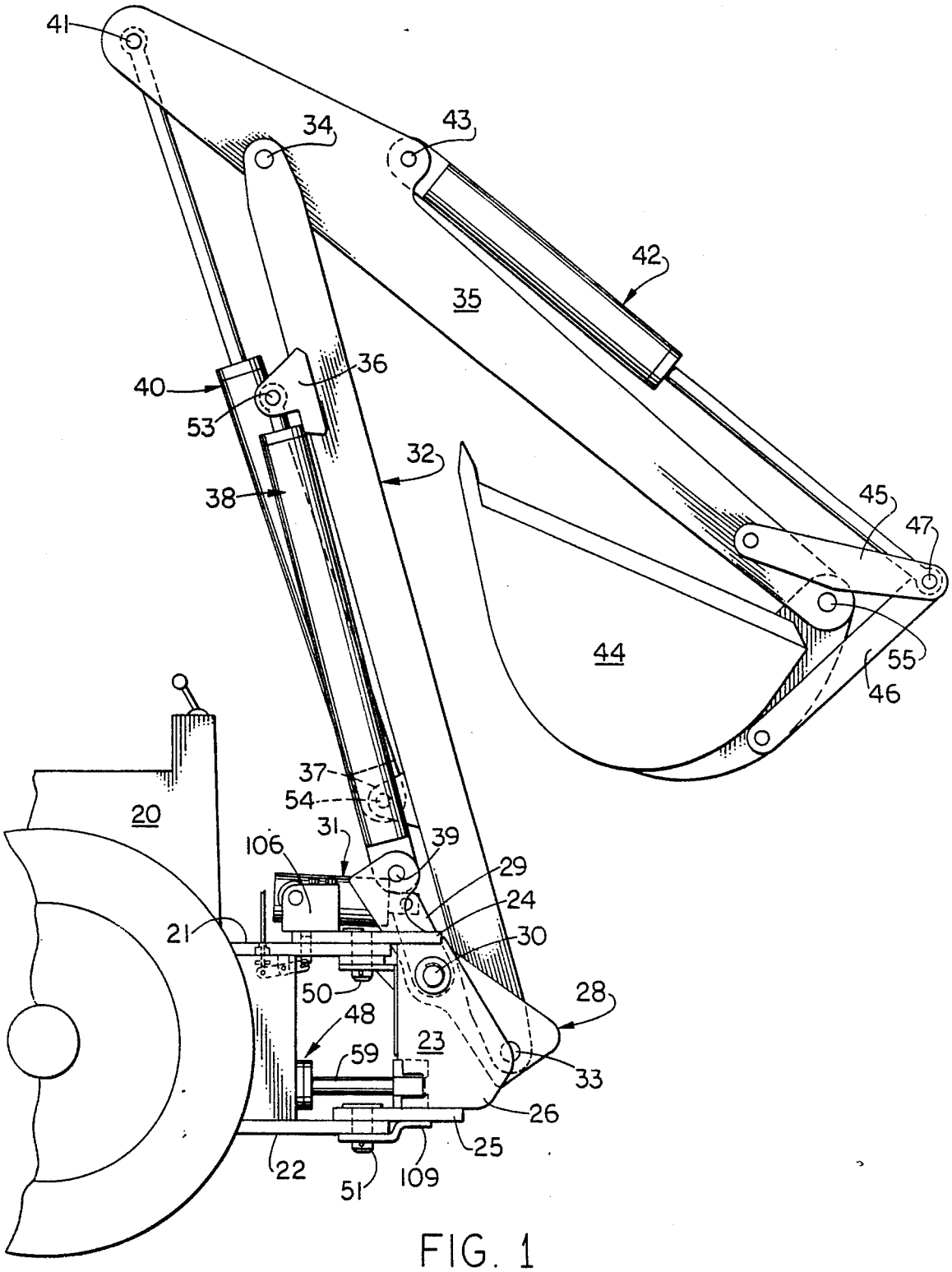
FIG. 1 is a side elevational view of a preferred form of my novel swing-tower mechanism as incorporated in a backhoe, showing the backhoe assembly proper in its retracted or transport position (rocker counter-clockwise)
Figure 3:
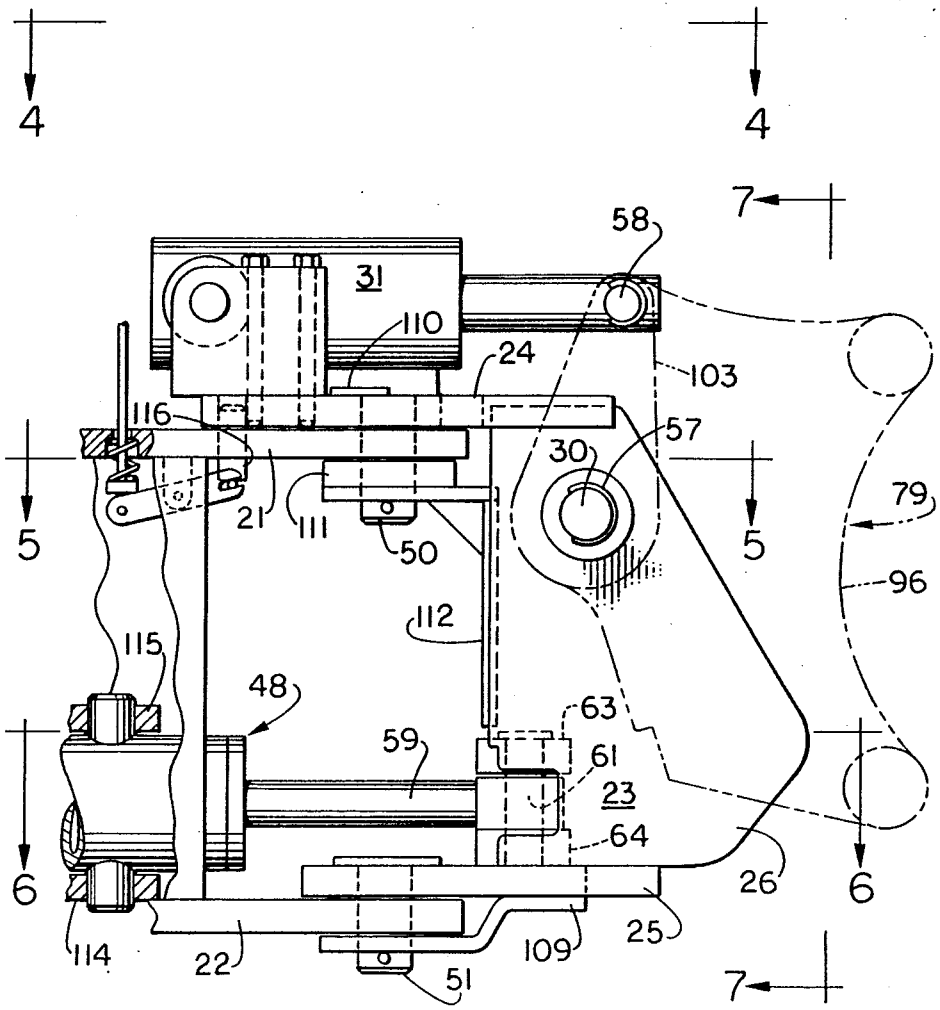
Figure 2:
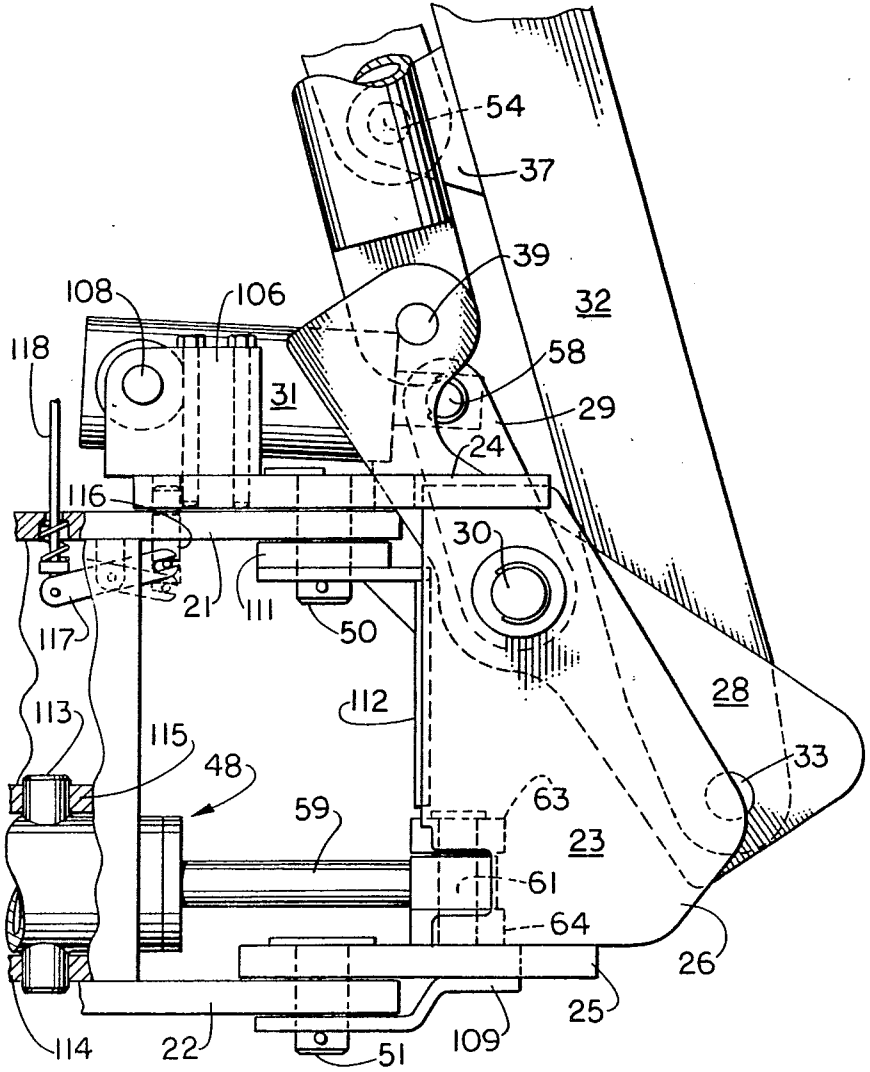
FIG. 2 is a side elevational view of my novel swing-tower mechanism, as incorporated in the FIG. 1 backhoe, showing the relationships of the swing tower, means adapted to be secured to a tractor for mounting it, means for positioning the tower in azimuth, the rocker, and means for positioning the rocker in elevation.
Figure 6:
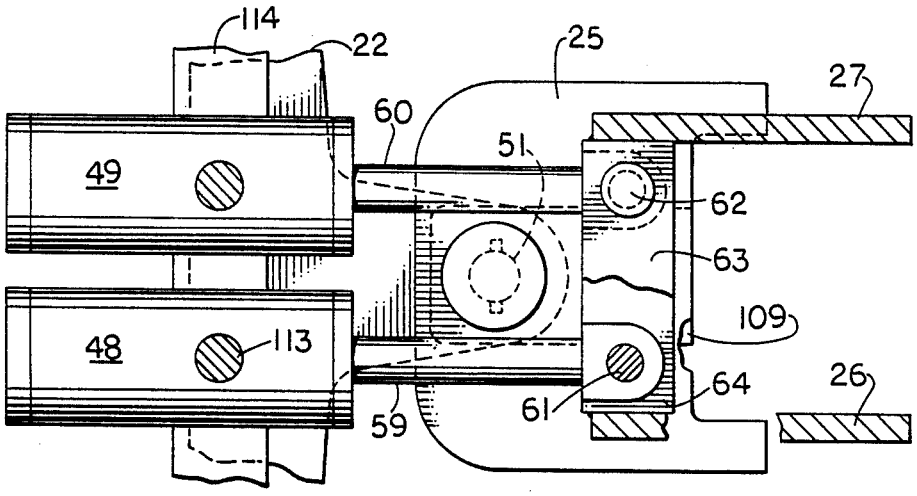
Figure 5:
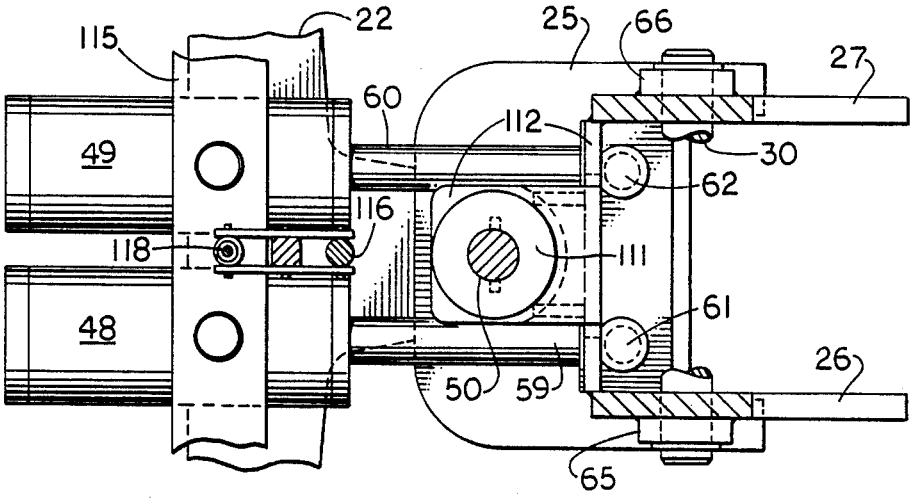
Figure 4:
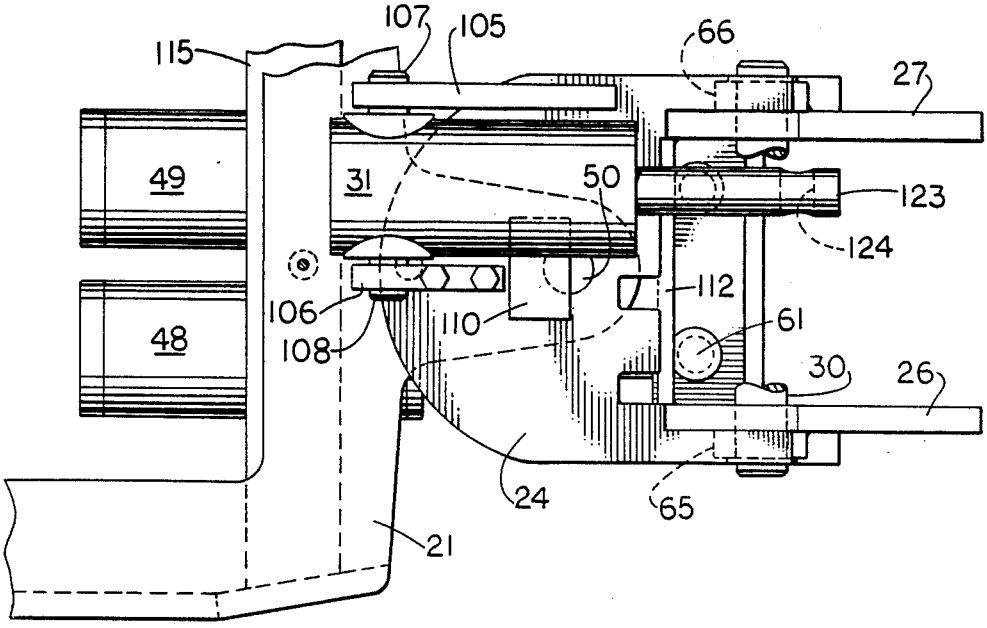
Figure 7:
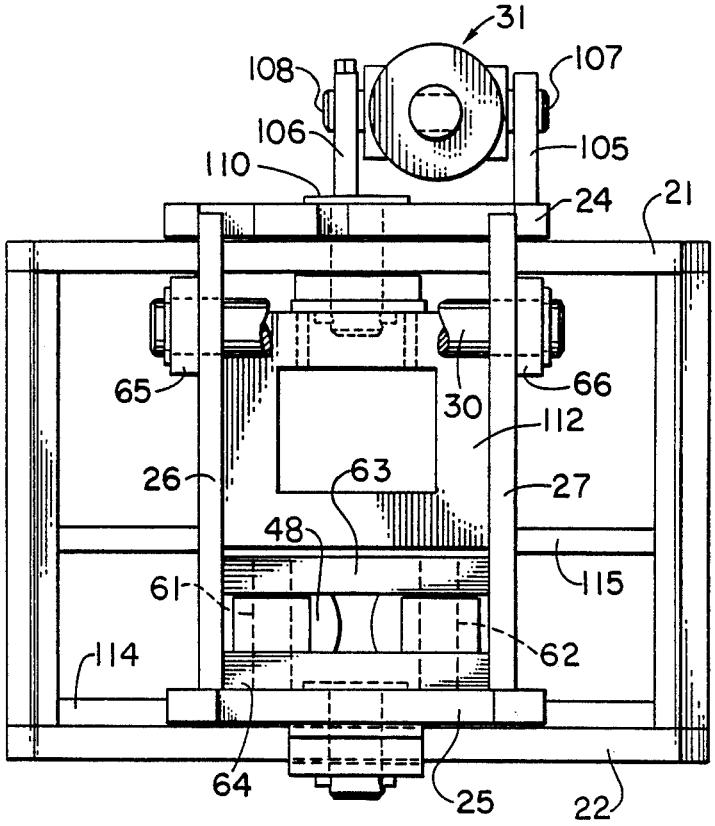
Figure 8:
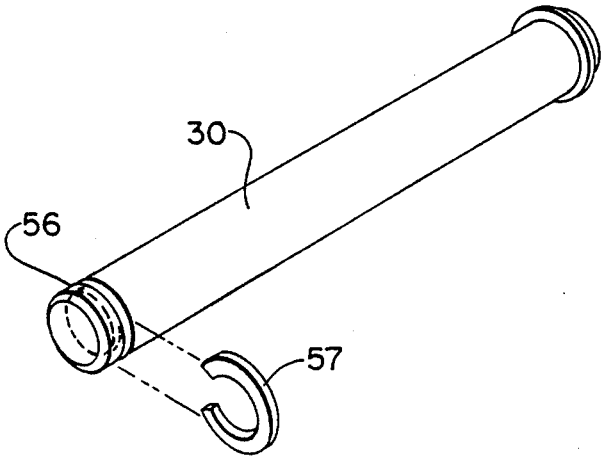
Figure 9:
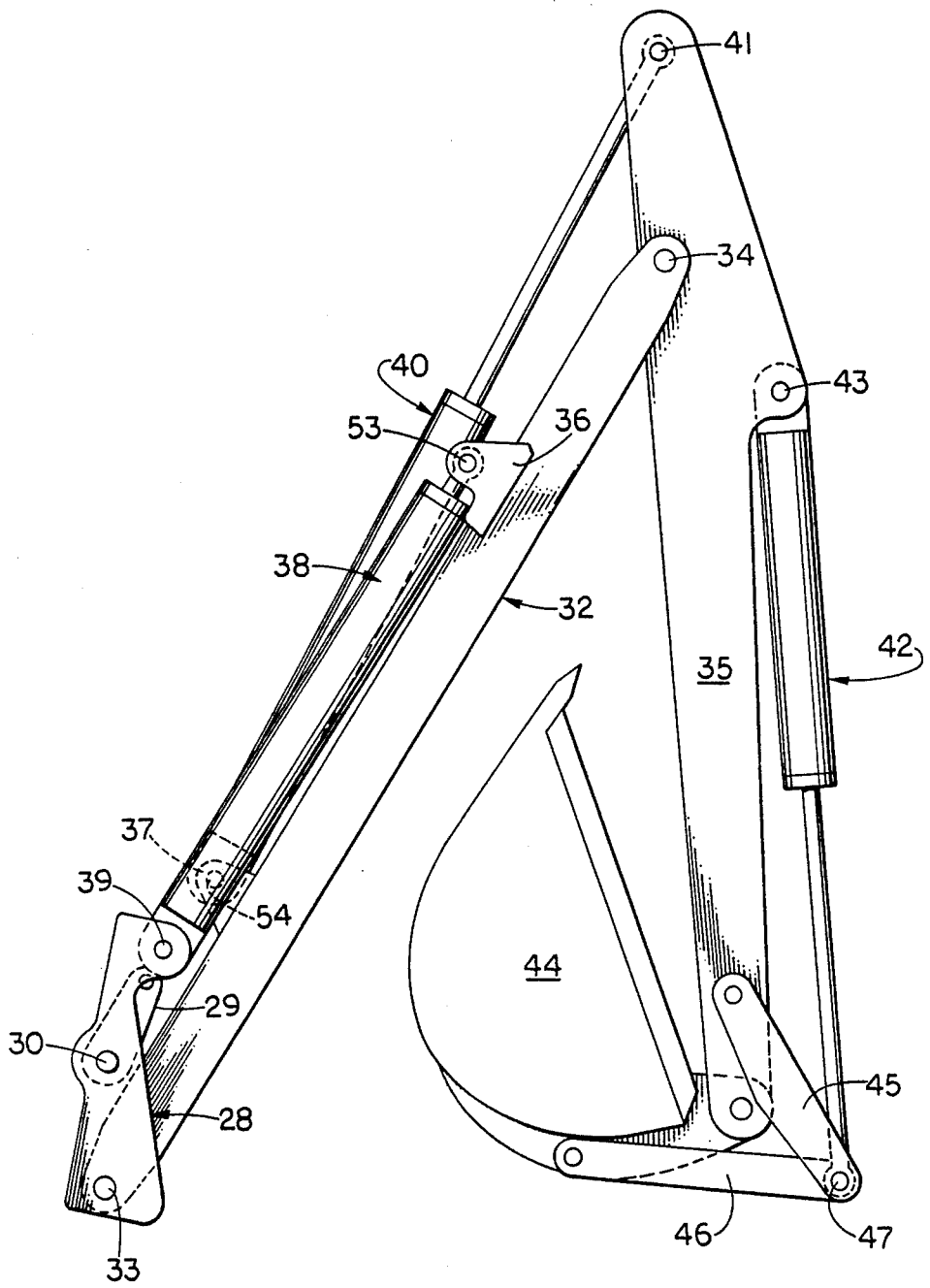
Figure 12:
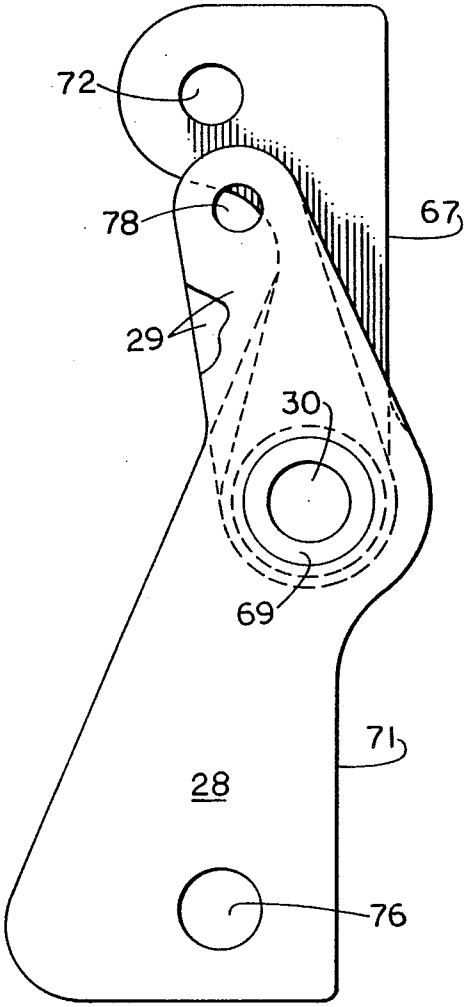
Figure 11:
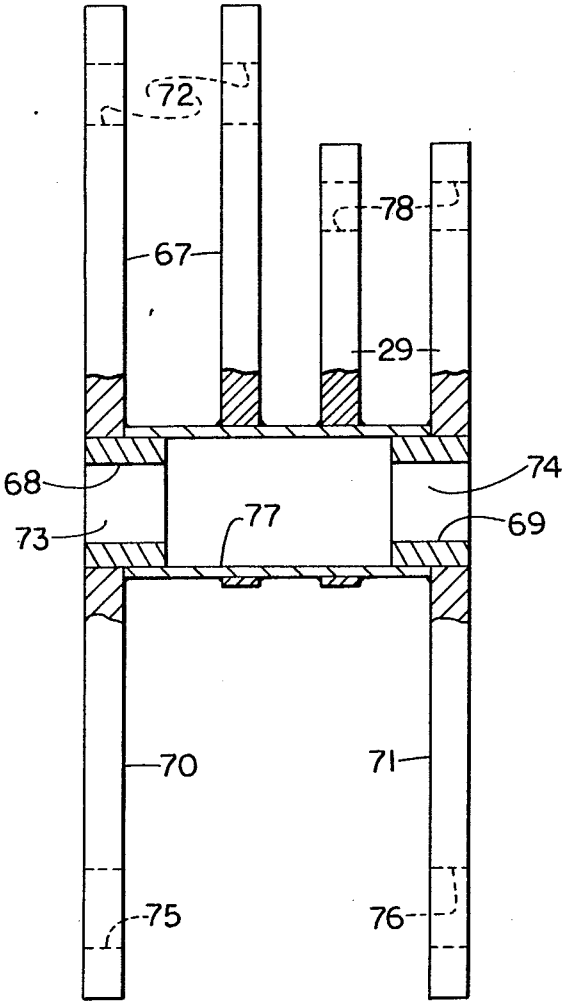
Figure 10:
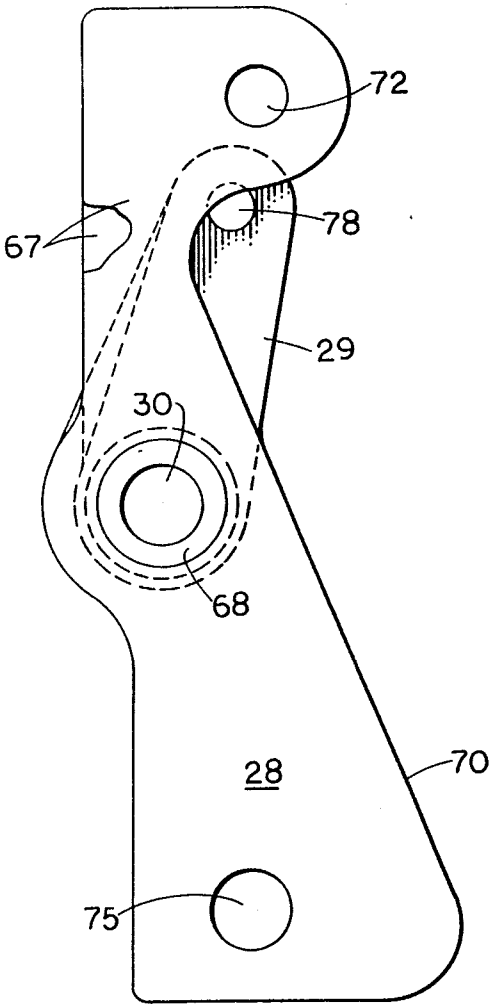
Figure 14:
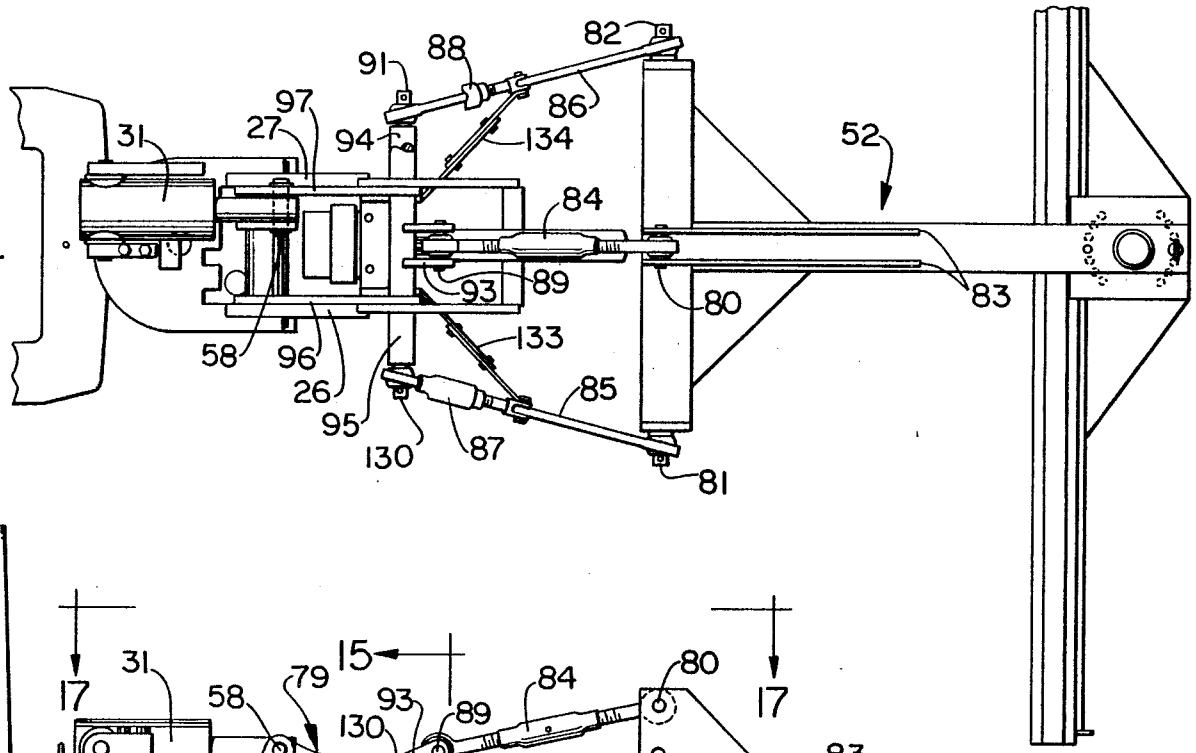
Figure 13:
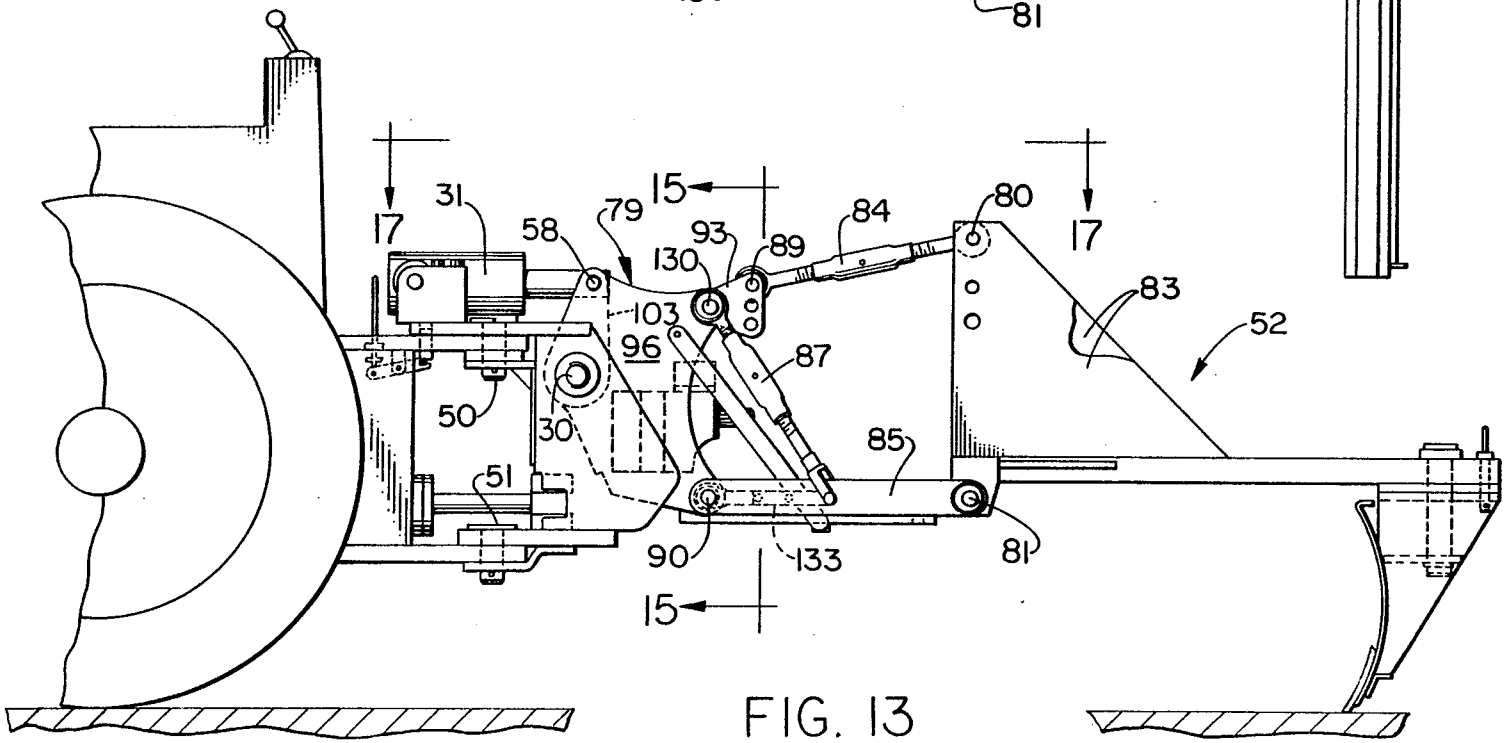
Figure 15:
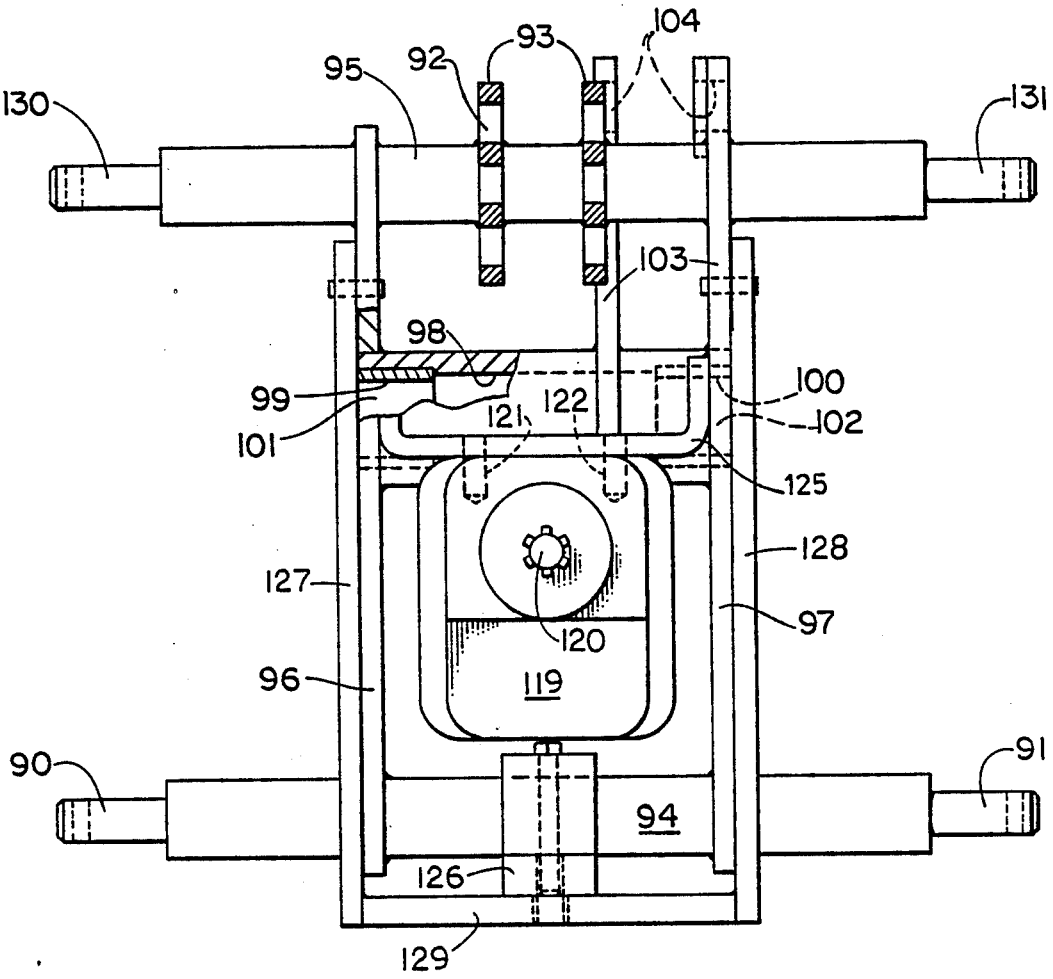

FIG. 3 is a side elevational view of my novel swing tower mechanism, generally resembling FIGS. 1 and 2, except for the substitution of an alternate form of rocker adapted to provide a three-point hitch arrangement, for towing and positioning in elevation a subordinate machine, the parts being shown in working position, wherein the upper hydraulic cylinder rod is extended to hold the rocker in clockwise position, corresponding to the lowered or working position of whatever subordinate machine is hitched to the rocker;

FIG. 4 is a top view of the FIG. 2 or FIG. 3 mechanism with the rocker removed;

FIGS. 5 and 6 are sectional views of the FIG. 2 or FIG. 3 mechanism, as taken along the respective section lines 5—5 and 6—6 of FIG. 3;

FIG. 7 is an end elevational view of the FIG. 2 or FIG. 3 mechanism, as taken from the line of view indicated by the arrows 7—7;

FIG. 8 is a perspective view of the pivot shaft and split ring which provide support for the rocker of the FIG. 2 or FIG. 3 mechanism;

FIG. 9 shows the backhoe assembly of FIG. 1, as removed from the swing tower, the rocker being shown in clockwise or working position and the boom and boom cylinder being shown in working position;

FIGS. 10, 11, and 12 are, respectively, front elevation, right end and rear views of the rocker of the FIG. 2 mechanism, FIG. 11 being broken to show details of the journal for the pivot shaft on which the rocker is mounted;

FIGS. 13 and 14 are side elevational and top views of the invention, as incorporated in a three-point hitch coupling for a tractor and a subordinate mechanism, such as a blade, an alternate form of rocker as shown in FIG. 3 and 15 being used;

FIG. 15 is a right end view of the rocker of FIG. 3, 13, 14, as taken from the line of view indicated by arrows 15—15. This figure also shows the power takeoff 119-120 of FIGS. 16, 17.

Figure 16:
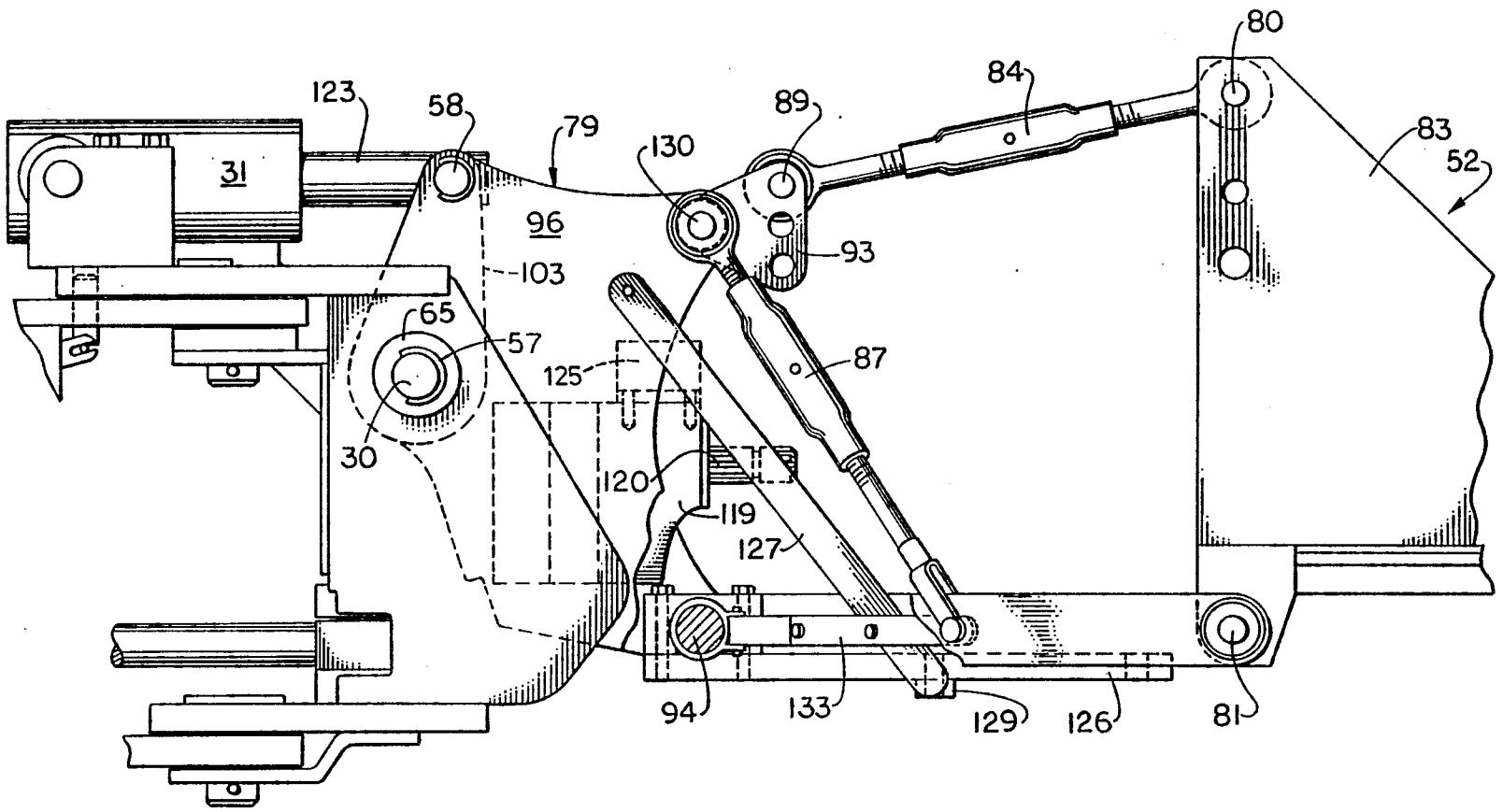
Figure 17:
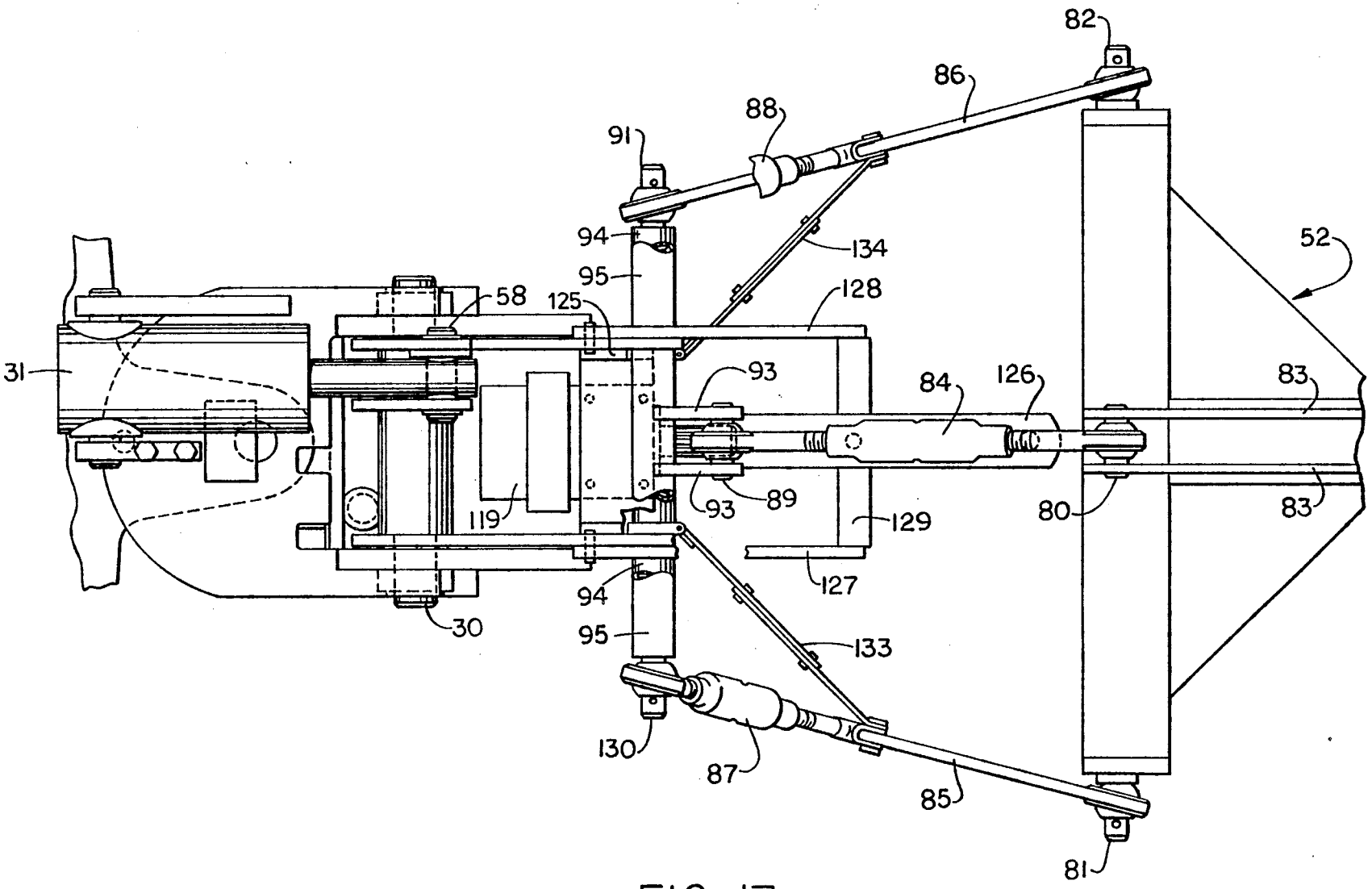

FIGS. 16 and 17 are side elevational and top views corresponding to FIGS. 13 and 14, respectively, but with the addition of a power takeoff shaft and hydraulic motor for same, said motor being mounted on the rocker for movement therewith, FIG. 16 also showing an optional drawbar 126.

Figure 18:
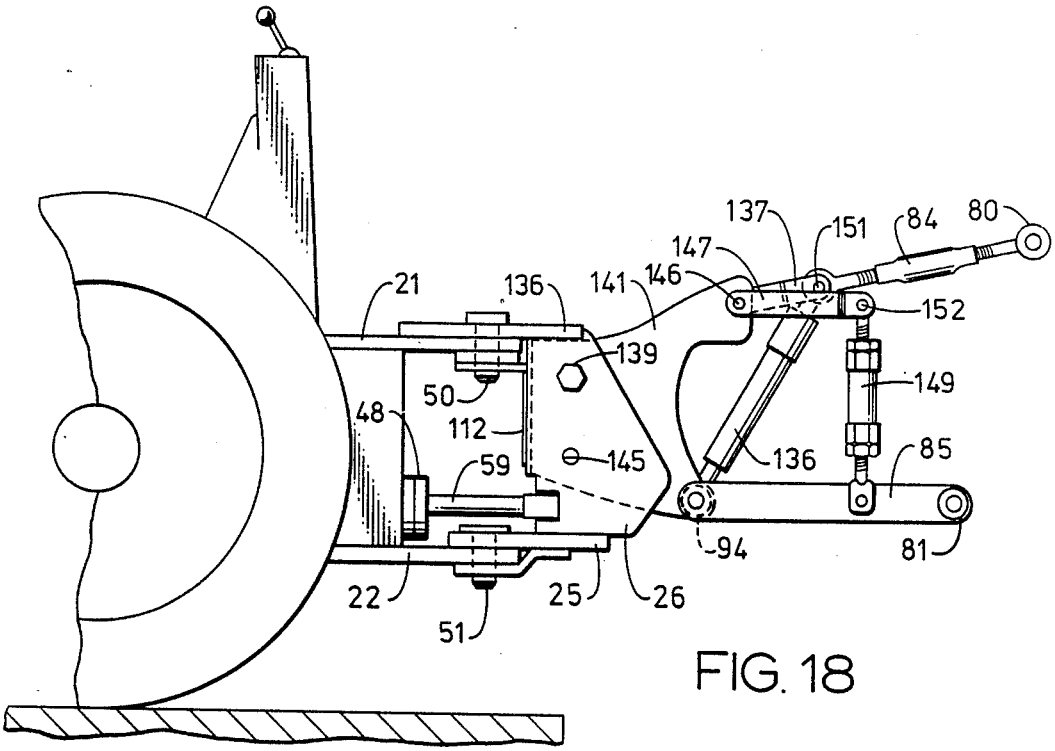
Figure 19:
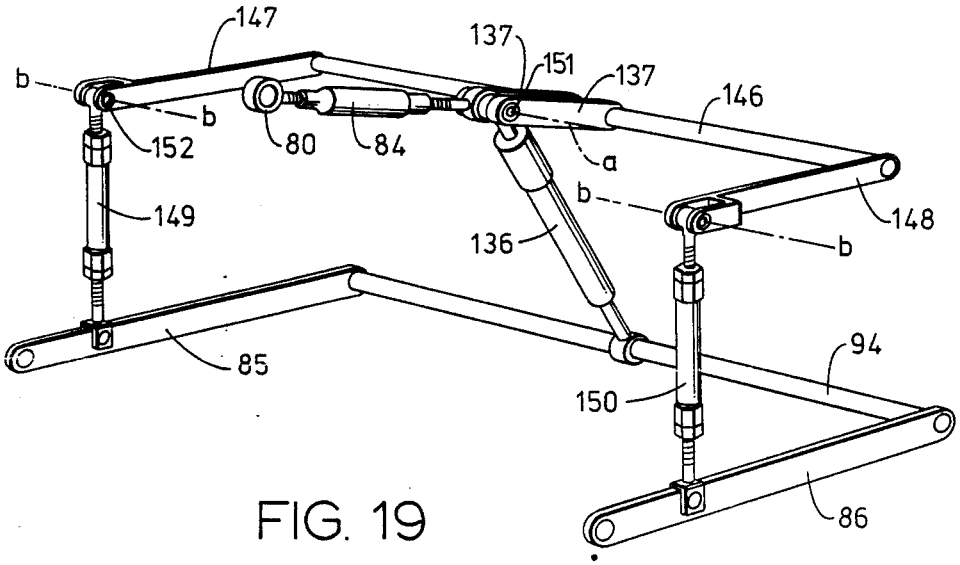

FIGS. 18 and 19 are side elevational and fragmentary views of the specific embodiment of swing tower, three-point hitch and azimuth and elevational positioning arrangement in which the hitch frame is secured to the swing tower and the elevational actuating means is mounted on the hitch frame. FIG. 19 is exploded to show the relationships among hitch-adjusting parts.

DESCRIPTION OF THE PREFERRED EMBODIMENT

Referring to FIG. 1, there is shown a novel position control and transport mechanism, as used in coupling tractor 20 (or other tractive vehicle) to a subordinate machine (in this figure a backhoe assembly). Secured to tractor 20 are vertically spaced upper and lower plates 21 and 22, constituting with pivot shafts 50 and 51 means for mounting a swing tower for movement in azimuth. A swing tower 23, formed with top and bottom plates 24 and 25 and side plates 26 and 27 (FIGS. 1 and 4) is accordingly mounted by pivot shafts 50 and 51 on the brackets 21, 22. In accordance with the invention, a rocker 28 is swingably mounted for movement in elevation on the swing tower by a generally horizontally extending shaft 30 projecting through side walls 26, 27 (FIG. 1, 4, and 5). Integral bosses 65, 66 (FIGS. 4, 5) are formed in side walls 26, 27, respectively, in order to provide journals for shaft 30. The expression "in elevation" as used herein is intended to cover angular displacement about a generally horizontal axis, such as shaft 30, whether the displacement is above or below the horizontal. "Elevation" will be understood therefore to include both elevation proper and depression.

In further accord with the invention, there is provided an actuating means or hydraulic cylinder 31, having its rod end pivotally secured to an integral arm 29 on rocker 28 whereby the elevational position and movement of rocker 28 and its subordinate machine (for example, the backhoe assembly of FIG. 9) are determined and controlled. The swing tower is moved and positioned in azimuth by suitable actuators such as the swing cylinders 48 and 49 (FIGS. 1, 4, 5, 6) here shown.

The novel position control and transport mechanism just described has the competence to support, transport, and control both in azimuth and elevation a range of loads and subordinate machines. Note that the rocker 28 articulates at the ends of its arms with the subordinate backhoe in that it is formed with spaced bore pairs 75,76 and 72,72 (accepting shafts 33 and 39, FIG. 11) A bore, 73,74 therebetween (accepting shaft 30) provides a pivot point between the ends of the rocker 28, so that it rocks on shaft 30.

In the FIG. 1 application the subordinate machine is a backhoe assembly. It is shown and described in detail in my U.S. Pat. No. 4,720,234. This mechanism will now be briefly described. A boom 32 is pivotally mounted on the rocker 28 by shaft 33. To the upper end of the boom 32 is pivotally secured, as by shaft 34, a dipper arm 35. The boom is provided with suitably offset and spaced ears 36 and 37. Boom cylinder 38 is pivotally secured to the upper end of the rocker by shaft 39. The rod of this boom cylinder 38 is pivotally secured to ear 36 on boom 32 by shaft 53. Dipper cylinder 40 is pivotally secured at its housing end to ear 37 on the boom 32 by shaft 54. The rod of dipper cylinder 40 is secured to dipper 35 by shaft 41. A bucket cylinder 42 is pivotally secured at its housing end to dipper arm 35 by shaft 43. The rod of bucket cylinder 42 actuates and positions knee joint shaft 47. Links 45 and 46 cooperate with the dipper cylinder rod to control the movement and positioning of bucket 44 which is pivotally mounted by shaft 55 at the working end of the dipper.

Reference is now made to FIG. 2 and 3 for further details pertaining to my novel position and control mechanism. The attribute of subordinate-machine-detachability is achieved in this machine by the arrangement of rocker and shaft 30. This shaft or pin means is formed with an annular groove, such as 56, at each end, and it is fitted with split rings, such as 57 (FIG. 8) so that it can easily be removed. Similar provisions are made for the ready removability of shaft 58 from arm 29 (FIG. 2) and the rod end of rocker cylinder 31. These provisions render very easy the removal of rocker 28 and the substitution of alternate types of rockers, such as the one providing for a three-point hitch as hereinafter described.

The backhoe assembly is easily detached by the removal of shafts 33 and 39 from their respective bores in rocker 28, they being provided with annular grooves and removable split rings for that purpose. Thus the substitution of other types of subordinate machines or loads is facilitated.

Swing cylinders 48 and 49 move the swing tower in azimuth. They are trunnioned for swinging movement between removable upper plate 115 and lower plate 114, the latter plate being on bracket 22 (FIGS. 2–6). They include connecting rods 59 and 60, respectively, pivotally secured to wrist pins 61, 62. The wrist pins are journaled in bores formed in upper bearing plate 63 and lower bearing plate 64 (FIG. 2, 3, 6). The plates 63 and 64 are welded to the sidewalls 26 and 27 of the rocker and they are suitably bored to provide for the wrist pins 61 and 62, and both plates are appropriately formed to permit the turning movement of the semi-circular ends of the rods 59 and 60 which bear the wrist pins, after the manner of connecting rods.

Rocker 28 (FIGS. 10–12) is formed with aligned hubs 68 and 69, a bifurcated upper section 67 and a shorter bifurcated control arm 29 and lower sections comprising relatively widely spaced sides 70 and 71. It will be understood that the left hand element 67 and element 70 of FIG. 11 are in one piece. Similarly, the right hand elements 29 and elements 71 of the same figure are one piece. Bores 72, 72 are formed near the upper ends of the rocker to accept shaft 39. Aligned bores 73 and 74 are provided in the hubs 68 and 69 to accept shaft 30. Bores 75 and 76 are formed near the lower end of the rocker to accept shaft 33. The hubs 68,69 are welded to a tubing 77 to which the other elements of the rocker are welded. Bores 78 in control arm 29 and bore 124 in rod 123 accept shaft 58 (FIGS. 2, 3, 4, 11).

The fittings are as follows: Rocker 28, pivoted on shaft 30, within sidewalls 26, 27; lower end of boom 32, pivoted by shaft 33 and within sides 70, 71 of the rocker; lower end of the boom cylinder 38, pivoted by shaft 39 and within bifurcation 67; end of rod of cylinder 31 bored to accept shaft 58 pivoted in bore 78 (FIG. 11).

DESCRIPTION OF THE THREE-POINT HITCH EMBODIMENT

Before dealing with additional structural details of the mechanism common to FIGS. 1–3, the description proceeds to the invention as supplying a three-point hitch between a tractor and a type of subordinate mechanism other than a backhoe. Referring now to FIGS. 3, 13, 14, and 15, there is shown a different version of rocker, generally designated as 79, and associated elements together constituting a three-point hitch. The main body of rocker 79 is roughly of quadrangular configuration with concavities on the face and top and a truncated lower rear (as best shown in FIG. 3), generally centrally of which rear are provided the bores for accepting shaft 30. The rocker 79 is fitted on the shaft and is controlled by the rocker cylinder 31, acting through shaft 58 in the same manner as with rocker 28. The rocker 79 is used to control the elevational position of the subordinate machine (such as blade 52 or any machine having a three-point hitch attachment).

The three-point attachment on blade 52 (FIG. 12) comprises pivot pins 80, 81, and 82 so located as to form apex points of an imaginary triangle. Each of these pivot pins is adapted to be secured as by a cotter pin to the ball joints of hitch links. A three-point hitch is formed by rocker 79 and the turnbuckle link 84 and links 85, 86 articulated thereto. At their inner ends the elements 84, 85 and 86 are secured by suitable ball joints to the pin portions 89, 90 and 91 respectively. Pin formations 90 and 91 are on the ends of lower rocker bar 94 (FIG. 15), and pin 89 is secured to a triangular bifurcation 93, welded to bar 95 (best shown in FIG. 13). Bifurcation 93 is provided with several generally vertically aligned bores, such as 92 (FIG. 15) to provide for adjustable positioning of the pivot pin 89. Bar 95 has pin ends 130 and 131. The rocker 79 (FIG. 15) is formed by plates 96 and 97. Bar 95 corresponds in position to shaft 39 (FIG. 1) and is secured to plates 96, 97. Adjustable straps 133 and 134 (FIGS. 13–14) are pivoted on bar 94 near its midpoint and their outer ends are pivoted to links 85, 86 near their midpoints. Bar 94 corresponds in position to shaft 33 and likewise projects through the plates 96, 97. Tube 98 connects the plates. Press fitted to the tube are hubs 99, 100, providing bores 101, 102 for shaft 30. Bifurcated control arm 103 is bored at 104 near its outer end to accept shaft 58, moved by rod 123 of cylinder 31. Adjustable straps 87 and 88 are pivoted to lower bar pins 130 and 131 and pivotally connected at their outer ends to links 85 and 86 to provide height adjustment. The hubs 99 and 100 mount rocker 79 in the same manner as rocker 28. Again, the elements of rocker 79 (FIG. 15) are welded together. From FIGS. 3 and 15 it will be seen that this rocker 79 is a mounting frame for a three-point hitch. This mounting frame has a pivot point 101, 102 in its midsection; i.e., between its end bars 95 and 94, the bars being articulated, respectively to the upper link and the lower link pair of the hitch.

The subordinate machine 52 is towed from the three-point hitch supplied by the rocker assembly 79. Actuator 31 positions the rocker in lift and working positions.

Because shaft 58 follows an arcuate path as rocker 79 shifts, the rocker cylinder is mounted for swinging movement between plate 105 (FIG. 4), welded to plate 24, and plate 106, bolted to plate 24. Trunnion members 107 and 108 are journaled between carriage plates 105 and 106, to secure the rocker cylinder for its small swinging movement so that the shaft 58 can follow the arm 29. The rocker cylinder is generally horizontally disposed to move upper bar 95 closer to the tractor when the rocker is in lifting position and to move bar 94 closer to the tractor when the rocker is depressed to working position.

Provision is made for the removal of the swing tower from the brackets 21, 22. As shown in FIGS. 2, 3, and 7, a lower bifurcated type of connection is provided by bent plate 109 underlying bracket 22. Pivot shaft 51 has an enlarged head and stem projecting through the elements 109, 22, and 25 (FIG. 3). The first step in the separation process is to withdraw pin 51. Another step in the separation process is to remove the wrist pin bearings 61 and 62, they likewise being formed with heads facilitating removal.

Pivot shaft 50 has an offset head 110 (FIG. 3) and a stem projecting through top plate 24, bracket 21, collar 111, and the top of an inverted L-shaped structural member 112, welded between the plates 26, 27 of the swing tower. As best shown in FIGS. 3, 4, 5 and 7, the L-shaped structural member 112 enhances structural rigidity. This member comprises a horizontal shelf portion, a vertical portion, and two gussets (FIGS. 3, 7) supporting the horizontal portion, all welded together. The head 110 of the pivot shaft 50 is rectangular in form and non-symmetrically located (FIGS. 3 and 4).

The swing tower can be locked against movement in azimuth, when desired, by a suitable detent 116, sliding in bores in bracket 21 and the swing tower top plate 24 and positioned by a slotted tilt member 117. This member 117 is spring biased into locking position, but can be tilted by a manually operated rod 118 (FIG. 2) to withdraw the detent.

Referring now to FIGS. 16, 17, which correspond closely to FIGS. 13, 14, respectively, there is shown an optional feature in the form of a power takeoff. A hydraulic motor 119, having a power takeoff shaft 120 is secured by bolts 121, 122 and the like to a U-shaped base 125, welded to the rocker 79. This base is seen in FIG. 15. In the event that a drawbar is desired for simple towing operations, it can be pivoted on the lower rocker bar as shown in FIGS. 16 and 17. The drawbar is designated by reference numeral 126. The drawbar is maintained in relation to the rocker by a U-shaped swinging frame comprising links 127 and 128 interconnected by a cross-member 129 which underlies the drawbar and is pivot-pinned to the rocker. The crossbar is bolted to the rocker as shown.

OPERATION

As to the embodiment of FIG. 1, involving a backhoe, the rocker 28 is positioned counter clockwise to provide for transport of the backhoe assembly. The rocker 28 is depressed to the clockwise position (FIG. 9) as the backhoe is working the ground or otherwise in operation. The shifting of the rocker is accomplished by the rocker cylinder 31. This cylinder, like all the others here involved, is of the double action type. The cylinder 31 greatly enlarges the utility of my novel arrangement because it is not dependent on subordinate machine contours. Once the shifting of the rocker 28 is achieved, the operation will be understood by reference to my U.S. Pat. No. 4,720,234.

As to the three-point hitch embodiment, those versed in the relevant art will perceive that the rocker 79 and associated links constitute such a hitch, working to provide support, tow and lift for the subordinate machines. If the subordinate machine requires a power takeoff, then the structure of FIGS. 16 and 17 not only provides such, but also moves it in elevation and azimuth along with the subordinate machine.

ADDITIONAL EMBODIMENT

In the embodiment of FIGS. 18–19, the 3-point hitch is selectively adjusted to transport and working positions by actuating means independent of the subordinate machine and separate and apart from the tower. The said hitch is secured to the swing tower and the relative angular movement of subordinate machine and swing tower in elevation is achieved by adjustment of the hitch internally. The swing tower has the usual upper and lower plates 136, 25, pivoted on tractor plates 21, 22, respectively. Actuators 48, 59 and 49, 60 (compare FIG. 6) positively and affirmatively swing the tower in azimuth. The 3-point hitch is formed with a frame having side walls such as 141, crossed by lower bar 94 and upper crank shaft 146. An upper link 84 extends from crank shaft short arm 137 to the subordinate machine and a pair of lower links 85, 86 extend from bar 94 to the machine to complete the hitch. Arms 147, 148 are outboard of the journals in the frame walls through which shaft 146 projects. To provide for selective adjustment of the hitch between transport and working positions actuating means 136, preferably hydraulic, is swiveled at its lower end at the middle of cross bar 94 and connected along axis a . . . a at its upper end to short crank 137 on shaft 146. Pivot pin 151 also secures link 84 to crank 137, which lifts and lowers the upper end of link 84. The spaced long arms or cranks 147 and 148 are pivotally linked at their outer ends to lifters 149,150 for lower links 85, 86, respectively, so that the lower links are angularly moved by the bell-crank expedients 147,149 and 148,150. Connections of link 149 and link 150 to arms 147,148 are made by pivot pins, such as 152, along axis b . . . b. The lifters are pivotally connected at lower ends to links 85,86. The frame walls, such as 141, are bored for shaft 146.

The hitch frame may be reinforced by additional cross-bars, not shown, if desired. The frame is mounted on or directly secured to the swing tower by quick-removable means such as a bolt-washer-nut set 139 or a pin and split ring (compare FIG. 8). Elements 21,22,25,26,48,50,51,59,84 through 86,94 and 112 correspond to like-numbered elements of FIGS. 16–17. The hitch frame sides nest within the swing tower sides. The frame is provided with a back wall, facing plate 112. Aligned openings 145 are formed in the side walls of hitch frame and swing tower to permit the use of additional securing means 139, if desired.

While there have been shown and described several embodiments of the invention, it will be understood that various changes and modifications may be made therein without departing from the proper scope of the appended claims.

I claim:

1. A position control and coupling mechanism for coupling a subordinate implement load to a tractor comprising, in combination:

a support, means for swingably attaching the support to the tractor so that it moves in azimuth about a vertical axis at the end of said tractor, means for positively driving said support in azimuth, said support being formed with a pair of spaced side walls, a rigid rocker to which the entire implement load is to be connected, said rocker having a pivot point in its midsection and being a part distinct from the implement, a pivotal mounting at said pivot point for securing the rocker to said spaced side walls and providing a single horizontal axis about which the entire implement load swings in elevation as well as means for detachment of the rocker, said rocker comprising two sides interconnected by an upper crossbar and a lower crossbar to make up a three-point hitch mounting frame, said rocker having a positioning arm, an actuator mounted on said swinging support and intercoupling said positioning arm and said swinging support for driving the rocker in elevation, the rocker being so mounted that when it swings to a lift position for the implement the upper crossbar moves closer to the tractor, and when it moves to a working position for the implement the upper crossbar moves away from the tractor, and a three-point hitch comprising an upper load-connecting link articulating with said upper crossbar and a lower pair of load connecting links articulating with said lower crossbar, the links completing the coupling of the subordinate implement, the articulations being in a geometrical pattern simulating the apices of a triangle, said hitch further comprising stabilizing means connected between the rocker and the lower connecting links.

2. In a position control and transport mechanism for coupling a subordinate implement to an end of a tractor, the combination of a swing tower attached to said end of said tractor for movement about a vertical axis displaced from said tractor, means intercoupling said tractor and said swing tower for driving the swing tower in azimuth, a rigid rocker distinct from the implement and shaped as a rigid three-point hitch mounting frame, said frame having a pivot point in its midsection and two outer formations for coupling to said implement, pivot means for swingably mounting the rocker for rotation in elevation about a single horizontal axis transverse to said swing tower and between a lift position at which the upper formation on the rocker is relatively closer to the tractor and a working position in which the upper formation is relatively further from the tractor than it was in the lift position, rocker actuating means mounted on said swing tower and mechanically coupled to said rocker for positioning said rocker in elevation, and linkage means connected to said frame and making with said frame a three-point hitch for transporting and elevationally positioning said implement in an arc about said single horizontal axis.

3. In a position control and transport mechamism for use in coupling a subordinate machine to a tractor, the combination of:

a swing tower, means secured to the tractor for mounting the swing tower for movement in azimuth, actuating means intercoupling said tractor and tower for swinging the tower, a pair of spaced side members and a hub secured therebetween to form a rigid rocker distinct from the machine, said rocker having a pivot point in its midsection and spaced formations for coupling it to the machine, pin means for swingably mounting the rocker for rotary movement in elevation on said tower between lift and working positions, said pin means projecting through said hub and being journaled on said tower so as to provide a single horizontal axis transverse to the longitudinal axis of the mechanism for the swinging movement of the rocker and machine, rocker-actuating means mounted on the tower and intercoupling the tower and the rocker for driving the rocker in elevation, and a hydraulic motor carried by said rocker and disposed between the spaced side members of said rocker, the motor including a power takeoff shaft directed toward the machine and transverse to said horizontal axis so that the power takeoff follows the angular movements of the machine in elevation and swings along with it in azimuth.

4. In a position control and transport mechanism for coupling a load in the form of a machine to a tractor, the combination of:

a swing tower attached to said tractor for movement about a vertical axis, means intercoupling said tractor and said swing tower for driving said swing tower in azimuth, a rigid load-bearing rocker shaped as a three-point mounting frame, said frame having a pivot point in its midsection, two sides and spaced formations for coupling to said machine, pivot means for swingably mounting the rocker for rotation in elevation about a horizontal axis transverse to said swing tower and between a lift position and a working position, rocker actuating means mounted on said swing tower and mechanically coupled to said rocker for positioning said rocker in elevation, linkage means connected to said frame and constituting with said frame a three-point hitch for transporting and elevationally positioning said machine, and a motor carried by said rocker and disposed between said sides, said motor having a power takeoff shaft directed to said machine and transverse to said horizontal axis, so that the motor follows the movements of the machine in elevation and swings with it in azimuth.

5. In a position control and transport mechanism for coupling a subordinate machine to an end of a tractor, the combination of a swing tower adapted to be attached to said end of said tractor for movement about a vertical axis displaced from said tractor, means for driving the swing tower in azimuth, a rocker distinct from the subordinate machine and shaped as a three-point hitch frame, said frame having upper and lower formations for coupling to said machine, means for mounting said rocker at a point between said formations for rotation in elevation on said tower and about a single horizontal axis, rocker-actuating means mounted on said swing tower and mechanically coupled to said rocker for swinging the rocker in elevation about said single axis and between a transport position in which the upper formation is relatively closer to the tractor and a working position in which the upper formation is relatively further from the tractor than it was in the transport position, and linkage means connected to said frame and making with said frame a three-point hitch.

6. The combination in accordance with claim 5 which further includes a hydraulic motor carried by said rocker, the motor having a power takeoff shaft directed toward the machine and transverse to said single horizontal axis so that the power takeoff follows the angular movements of the machine in elevation and azimuth.

7. A position control and transport mechanism for coupling a subordinate load to an end of a tractor, comprising, in combination:

a swing tower adapted to be attached to said tractor for movement on a vertical axis fixed in relation to said tractor, first actuator means directly intercoupling said tractor and said swing tower for positively positioning said swing tower in azimuth, a three-point hitch constituting the sole connection to said subordinate load and having a frame distinct from said swing tower and a linkage secured to and extending from said frame, quick-assembly and quick-removal means for connecting said frame to said swing tower, said hitch being selectively adjustable both to elevate the load to transport position and to depress the load to working positions, and hydraulic actuator means, independent of said tractor and said load and movable in azimuth with said swing tower, for adjusting said hitch, whereby the position of the load is indirectly controlled in azimuth by the swing tower and directly controlled in elevation solely by the hitch.

8. A working position and transport position control mechanism for coupling a subordinate machine load to a tractor comprising, in combination:

a swing tower attached to the end of said tractor for movement about a fixed vertical axis, means intercoupling said tractor and said swing tower for driving said swing tower in azimuth, said swing tower having a pair of spaced side walls formed with aligned bores, a rigid rocker formed with a frame and a three-point hitch linkage for connection to said machine, said rocker having an aperture for registry with said bores, pin means projecting through said aperture and said aligned bores to provide a single horizontal axis for swingably mounting said rocker for angular movement in elevation, means for driving said rocker and its load to and between both transport and working positions, said means comprising an actuator mounted on said swing tower and pivot means for articulating the actuator and the rocker, and readily separable retainer means fitted to said pivot means and said pin means to provide for quick attachment and detachment of said rocker and load from said swing tower and also for facilitating installation and removal of a substitute rocker, said load and said means for driving the rocker being so proportioned as to achieve transport as well as positioning of the load without resort to lifting the swing tower.

9. In a position control and transport mechanism for coupling a subordinate machine to a tractor, the combination of a swing tower for swinging movement about a vertical axis fixed in relation to said tractor, a rocker formed with a frame and a three-point hitch linkage for connection to said machine, means for pivotally mounting said rocker on said swing tower for movement in elevation about a horizontal axis, actuator means mounted on the swing tower for driving said rocker and its machine load in elevation, and a motor carried by said rocker frame, said motor having a power takeoff shaft directed to said machine load and transverse to said horizontal axis, so that the motor and shaft follow the machine load in azimuth and elevation.

* * * * *